United States Patent [19]

Szendre et al.

[11] Patent Number: 4,993,251

[45] Date of Patent: Feb. 19, 1991

[54] ROLLSTAND HAVING EASILY REPLACEABLE ROLL DIES

[75] Inventors: David J. Szendre, Kennewick; Jon L. Osborne, Richland; Charles S. Rutkowski; Anthony A. Duerring, both of Kennewick; Bruce O. Foster, Benton City, all of Wash.

[73] Assignee: Sandvik Special Metals Corporation, Kennewick, Wash.

[21] Appl. No.: 376,576

[22] Filed: Jul. 7, 1989

[51] Int. Cl.[5] ..... B21B 21/00; B21B 31/00

[52] U.S. Cl. ..... 72/214; 72/238

[58] Field of Search ..... 72/208, 214, 237, 238, 72/239, 249

[56] References Cited

U.S. PATENT DOCUMENTS

| | | | |
|---|---|---|---|
| 3,570,294 | 3/1971 | Shibata | 72/208 |
| 3,813,911 | 6/1974 | Bibighaus | 72/208 |
| 4,373,367 | 2/1983 | Fabris | 72/250 |
| 4,471,642 | 9/1984 | Wilson | 72/238 |
| 4,562,713 | 1/1986 | Kondoh | 72/214 X |
| 4,660,400 | 4/1987 | Potapov et al. | 72/214 |
| 4,763,505 | 8/1988 | Klute et al. | 72/238 |

FOREIGN PATENT DOCUMENTS

| | | | |
|---|---|---|---|
| 0072765 | 2/1983 | European Pat. Off. | 72/214 |
| 60-166108 | 8/1985 | Japan | 72/214 |
| 1148660 | 4/1985 | U.S.S.R. | 72/214 |
| 2124934 | 2/1984 | United Kingdom | 72/214 |

*Primary Examiner*—E. Michael Combs

*Attorney, Agent, or Firm*—Burns, Doane, Swecker & Mathis

[57] ABSTRACT

A rocker mill for reducing the diameter of metal tubes includes a rollstand mounted on a reciprocable sled. The rollstand includes upper and lower roll dies between which the tubes travel as the sled and rollstand are reciprocated. The roll dies are mounted on tapered segments of respective arbors to facilitate removal of the roll dies. The arbors are driven by respective spur gears which are in meshing relationship on one side of the rollstand. One of the spur gears is driven by a pinion gear coaxially attached thereto on the same side of the rollstand as the spur gears. The rollstand is arranged to be slid horizontally from the sled after a plurality of fasteners have been released. A stationary toothed rack which drives the drive gear is spring-biased vertically to raise the rack in order to facilitate the sliding of the rollstand off the sled.

10 Claims, 5 Drawing Sheets

Fig. 1
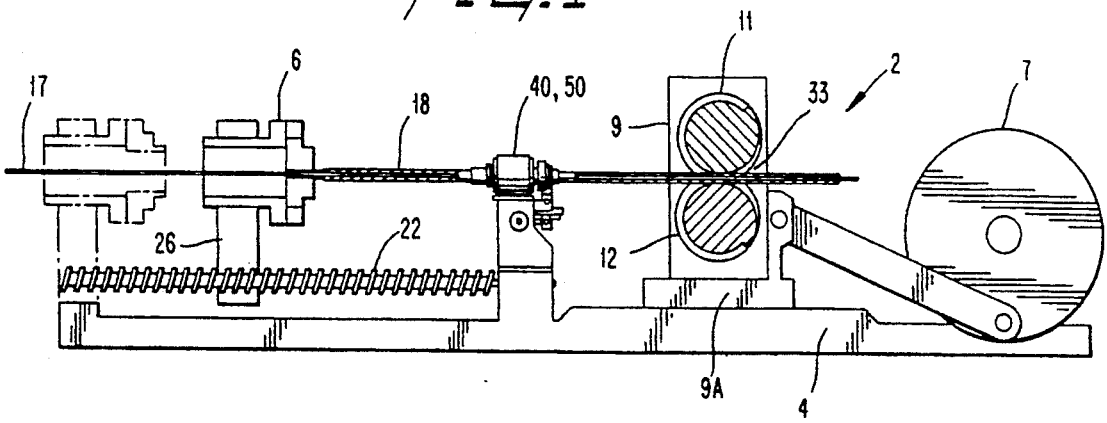
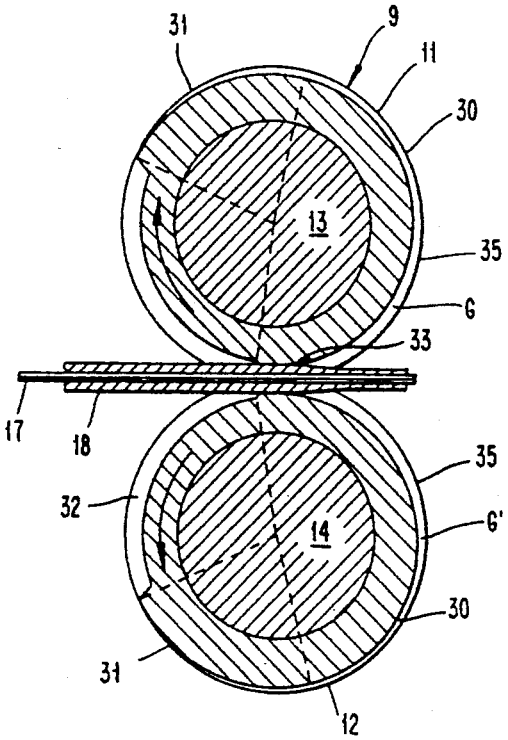
Fig. 2
Fig. 3
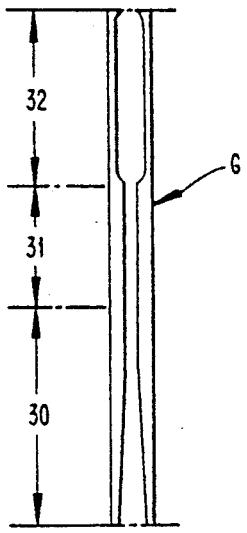

ROLLSTAND HAVING EASILY REPLACEABLE ROLL DIES

BACKGROUND AND OBJECTS OF THE INVENTION

The present invention relates to precision rocker mills of the type which produce tubes from hollow metal workpieces.

A rocker mill of that type is disclosed for example in Kondoh U.S. Pat. No. 4,562,713 and in copending U.S. application Ser. No. 297,431 filed Jan. 17 1989 U.S. Pat. No. 4,930,328. Such mills typically include a movable rollstand which is reciprocated along a hollow workpiece. The rollstand includes a pair of grooved roll dies which define a nip through which the workpiece is passed so as to be radially compressed. A mandrel is disposed within the workpiece to radially support the inside of the workpiece. The workpiece is progressively advanced and rotated as the rollstand is reciprocated therealong.

The grooves of the roll dies are of progressively narrowing width in the circumferential direction. Thus, by rotating the roll dies, the workpiece is subjected to a progressively increasing radial compression whereby the diameter of the workpiece is progressively reduced.

In practice, when a rolling operation has ended it is occasionally necessary to replace the roll dies, e.g., after they have become worn or are to be replaced by roll dies having differently sized grooves. Heretofore, the roll die replacement operation has involved appreciable time and difficulty. For example, considerable disassembly of parts is performed while the rollstand remains in the mill, a practice which can result in considerable downtime of the machine. It has been known to lift the rollstand from the mill, but this requires the need to provide an overhead crane, or the like, which is cumbersome and expensive. Also, conventional roll dies are mounted on parallel steel arbors which themselves are mounted in bearings within the rollstand. Spur gears are coaxially attached to the arbors on one side of the rollstand so as to be in meshing engagement, and a pinion gear is coaxially attached to one of the arbors at an opposite side of the rollstand. The pinion gear meshes with a toothed rack whereby relative movement between the rack and pinion gear causes the pinion gear to rotate. The spur gear which is coaxially attached to the pinion gear is thus rotated and causes the other spur gear to rotate as well. Consequently, the arbors and roll dies are rotated in unison. It will be appreciated that replacement of the roll dies involves the need to remove the spur gears, thereby lengthening the down time of the mill.

As an alternative arrangement, the spur gears can be eliminated and instead two pinion gears are disposed on opposite sides of the roller mill and are arranged to mesh with respective racks. However, such an arrangement presents even more difficulty in removing the roll dies since there is always a rack in the way.

Furthermore, the roll dies are typically mounted to the arbors by a heat-shrinking operation. Thus, in order to replace the roll dies it has been necessary to take the roll die/arbor units to a heat-treatment facility.

In addition, the presence of the spur gears complicates the process of adjusting the vertical relationship of the roll dies. Such adjustment is typically made in repeated steps during a rolling operation. That is, after the workpiece has been subjected to one or more rolling strokes, the machine is stopped and an operator measures the diameter of the workpiece to determine whether the roll dies are properly spaced apart. This procedure is performed repeatedly before a position of final adjustment can be achieved. The measuring of the workpiece is performed at the nip zone of the roll dies, requiring that the operator reach around an end of the rollstand. Due to the confined nature of the space within the mill housing in which the rollstand is located, it is difficult to perform this measuring step, the difficulty being aggravated by the presence of the spur gears.

SUMMARY OF THE INVENTION

The present invention relates to a rocker mill for reducing the diameter of elongated cylindrical workpieces. The rocker mill comprises a rollstand mounted for reciprocable movement in a front-to-rear direction. The rollstand includes upper and lower vertically superimposed bearing blocks, and an adjusting mechanism for adjusting a vertical spacing between those bearing blocks. First and second bearings are mounted in the upper bearing block, and third and fourth bearings are mounted in the lower bearing block. An upper arbor is rotatably mounted in the first and second bearings for rotation about an upper axis extending from a first side of the rollstand to a second side thereof perpendicular to the front to rear direction. The upper arbor includes first and second outer peripheral portions on which the first and second bearings, respectively, are mounted. The first outer peripheral portion tapers toward the first side of the rollstand and the second outer peripheral portion tapers toward the second side of the roll stand. A lower arbor is rotatably mounted in the third and fourth bearings for rotation about a lower axis extending parallel to the upper axis. The lower arbor includes third and fourth outer peripheral portions on which the third and fourth bearings, respectively, are mounted. The third outer peripheral portion tapers toward the first side of the roll stand, and the fourth outer peripheral portion tapers toward the second side thereof. Upper and lower roll dies are mounted on fifth and sixth outer peripheral portions of the upper and lower arbors, respectively, for rotation therewith. The fifth and sixth peripheral portions taper toward the first side of the rollstand. Each of the roll dies includes a groove on its outer periphery. The roll dies are arranged such that the grooves are vertically superimposed to form a nip zone therebetween for compressing a workpiece. An upper tapered sleeve is tightly mounted radially between an inner peripheral portion of the upper roll die and the fifth outer peripheral portion. A lower tapered sleeve is tightly mounted radially between an inner peripheral portion of the lower roll die and the sixth outer peripheral portion. Upper and lower driven gears are connected coaxially to the upper and lower arbors, respectively, at the second side of the rollstand, the driven gears being in meshing engagement. A drive gear is disposed at the second side of the rollstand and is connected coaxially with one of the driven gears. A stationary rack extends in a front-to-rear direction and meshingly engages the drive gear. The rollstand is reciprocated in a front-to-rear direction relative to the rack whereby the driving gear is rotated to drive the one driven gear which, in turn, drives the other driven gear for rotating the arbors and roll dies. The workpiece is advanced through the nip zone as the rollstand is being reciprocated, whereby the diameter of the workpiece is reduced.

The invention also relates to a rollstand/sled arrangement wherein the rollstand can be slid horizontally from the sled to enable a new rollstand to be installed. A toothed rack which drivingly engages a drive gear of the rollstand is provided with means for displacing the rack upwardly to facilitate removal of the rollstand.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 1 is a schematic side elevational view of a rocker mill containing a rollstand according to the present invention;

FIG. 2 is a schematic vertical sectional view taken through the roll dies of the rollstand as a workpiece is being reduced thereby;

FIG. 3 is a schematic side elevational view of a workpiece-reducing groove of a roll die;

DETAILED DESCRIPTION OF A PREFERRED EMBODIMENT OF THE INVENTION

Figure 4:
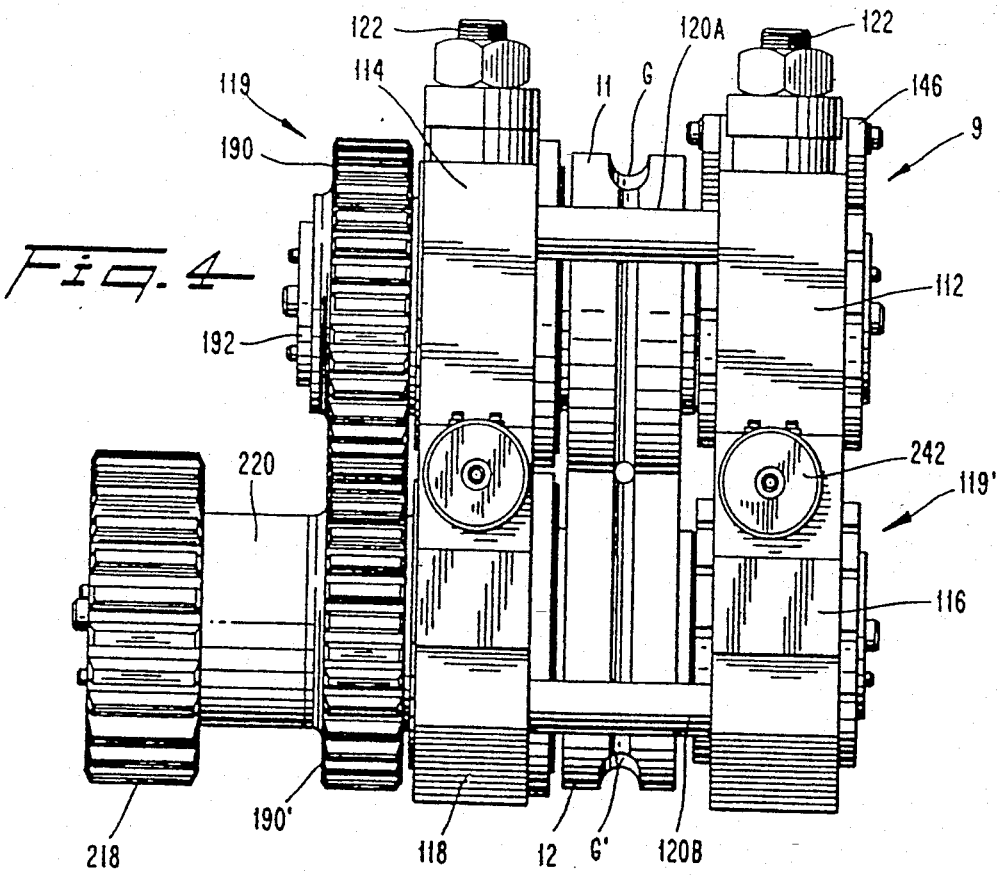
FIG. 4 is a front elevational view of the rollstand according to the present invention.
Figure 5:
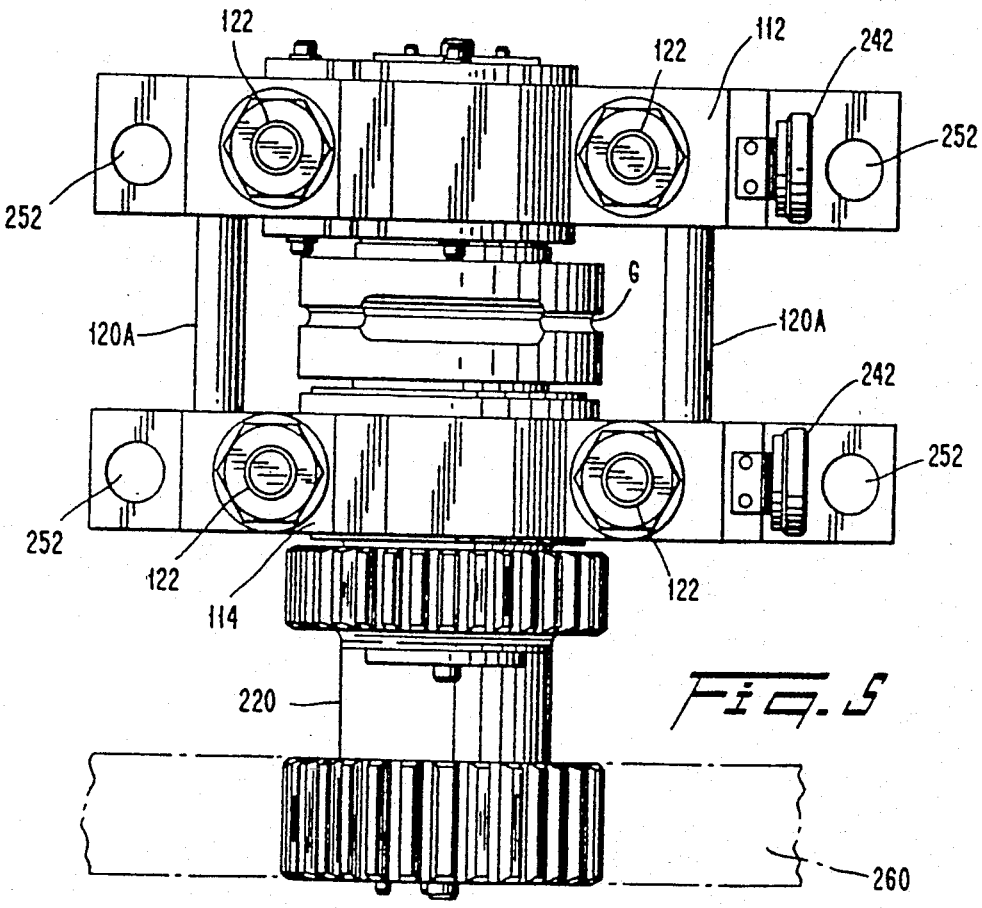
FIG. 5 is a top plan view of the rollstand.

Referring to FIG. 1 of the drawing, a rocker mill 2 is represented schematically which includes a stationary base 4, a conventional movable chuck 6 in which is securely clamped to a cylindrical mandrel 17. The mandrel is positioned within a workpiece 18 and has a uniform external diameter which is only slightly less than the internal diameter of the workpiece. The right-hand end of the workpiece 18 is disposed in a forming zone 33 in which it is subjected to a forming operation performed by a pair of roll dies 11 and 12 of a movable rollstand 9. The rollstand 9 is affixed to a conventional sled or saddle 9A which, in turn, is guided for reciprocation along a track (not shown). The saddle is oscillated by a crank arm assembly 7 such that the forming zone 33 is reciprocated axially with respect to the workpiece.

During the forming operation, the workpiece is advanced step-by-step into the forming zone by a screw thread assembly having a threaded shaft 22 extending through a supporting bracket 26 for the chuck 6. During each step movement of the workpiece and the mandrel, the workpiece is turned about its axis a predetermined number of degrees. Turning may be performed either at the movable chuck 6 or elsewhere, as will become apparent from the following discussion.

Referring now to FIGS. 2 and 3, the roll dies 11 and 12 are mounted upon upper and lower arbors 13 and 14, respectively, and have grooves G, G' (see FIG. 3). The arbors rotate about upper and lower parallel horizontal axes UA and LA. Each groove comprises a primary forming portion 30, a finishing portion 31, and a dwell portion 32. The surfaces of portions 30 and 31 of each of the grooves have generally semi-circular cross-sections, the axes of which are concentric with the axis of the mandrel and the workpiece when the respective portions of the groove mate at the forming zone 33. The peripheral edges 35 of the roll dies converge during rotation to form therebetween a pinch zone or nip zone in which the workpiece is compressed. The arc of the dwell portion 32 relative to the roll is usually on the order of 60 to 120 degrees. The primary forming portion 30 is usually longer than the finishing portion 31, and the dwell portion extends the remainder of the circumference of the roll die.

During operation, the rollstand oscillates to the right and left from the position shown in FIG. 1 and is, in fact, moving to the right in a primary tube-forming movement of stroke. At that time, portions 30 of the grooves are engaging the workpiece, with roll die 11 turning clockwise and roll die 12 turning counterclockwise by means to be described in greater detail hereinafter. The movement of the rollstand relative to the rotation of the roll dies is such that the finishing portions 31 of the grooves mate at their ends adjacent the dwell portions 32 when the rollstand and roll dies are in the extreme right-hand position. The movement is then reversed simultaneously so that the roll dies start to turn in their respective opposite directions at the same time that the rollstand starts to move the roll dies to the left. Some or all of the reduction is normally taken on the forward stroke from the left to the right. Depending on the movement of the workpiece when the roll dies roll over the workpiece, some or all of the deformation work can be taken during the return stroke from the right to the left.

When the rollstand approaches its extreme lefthand position, the roll dies have turned so that the dwell portions 32 of the grooves are mating, i.e., little if any, pressure is applied to the workpiece. At that time, a step-feed movement is produced by turning screw shaft 22 so as to feed the workpiece and the mandrel one step to the right. Simultaneously, chuck 6 conventionally rotates the workpiece the predetermined number of degrees as referred to above. The rollstand movement is then reversed, with the leading ends of the portions 30 of the grooves (shown at the bottom of FIG. 3) moving onto the workpiece and engaging the portion of the workpiece which has been moved into the range of the roll dies by the last step advance. That produces the tube-forming step with the metal flowing axially along the mandrel. There is a resultant increase in tube length which is manifested at the free end of the workpiece, i.e., the right-hand end depicted in FIG. 1. For a more detailed discussion of the above-described operation, reference may be had to copending application Ser. No. 07/297,431 filed Jan. 16, 1989.

Figure 10:
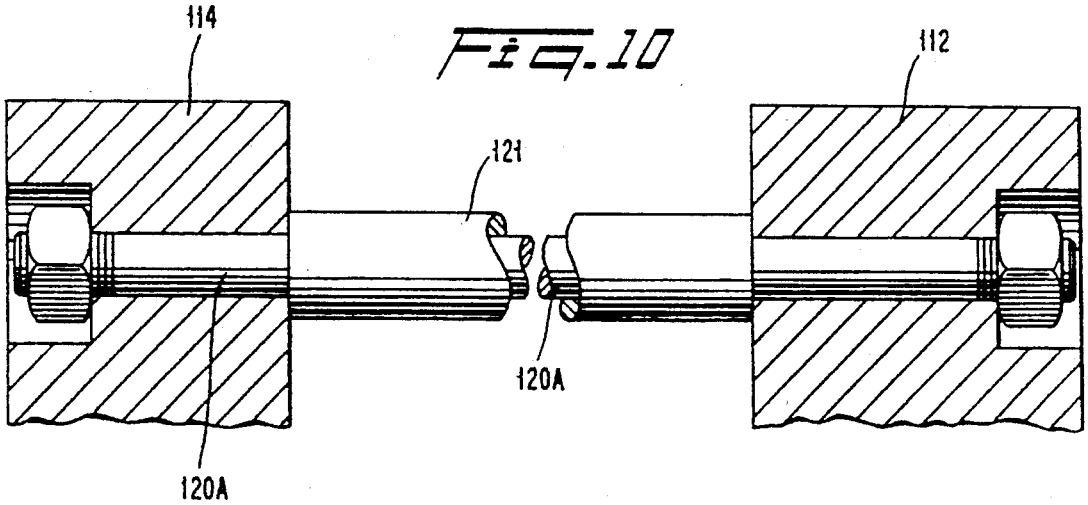
FIG. 10 is a fragmentary view, partially in section, of a connecting bolt and associated spacer taken along the line 10—10 in FIG. 6.

The rollstand 9 according to the present invention comprises four bearing blocks, namely, right and left upper bearing blocks 112, 114 and right and left lower bearing blocks 116, 118. An upper assembly 119 comprised of the upper bearing blocks 112, 114 is held together by two conventional horizontal coupling bolts 120A, and a lower assembly 119' comprised of the lower bearing blocks 116, 118 is held together by two conventional horizontal coupling bolts 120B. A spacer 121 (FIG. 10) is mounted on each coupling bolt to space the associated blocks apart. As will be explained subsequently, the upper assembly 119 secured to the lower assembly 119' by four conventional vertical draw bolts or tension bolts 122, two of which interconnect the right upper and lower bearing blocks 112, 116 and the other two of which interconnect the left upper and lower bearing blocks 114, 118.

Each of the draw bolts 122 passes through the respective upper bearing block 112, 114 and is threadedly received in the respective lower bearing block 116, 118. Surrounding an upper end of each draw bolt 122 is a shearing die 124, a shearing washer 126, and a shearing ring 128 (FIG. 6), all of which are conventional. A threaded nut 130 is threadedly connected to the upper end of each draw bolt 122. In the event that the upper assembly 119 is urged upwardly by an excessive force, e.g., by the presence of an unduly large workpiece in the nip zone of the roll stand, the shearing die 124 shears the shearing washer 126 and vertically enters a recess 129 formed in the shearing ring 128, thereby avoiding an over-straining of the draw bolt 122.

Figure 7:
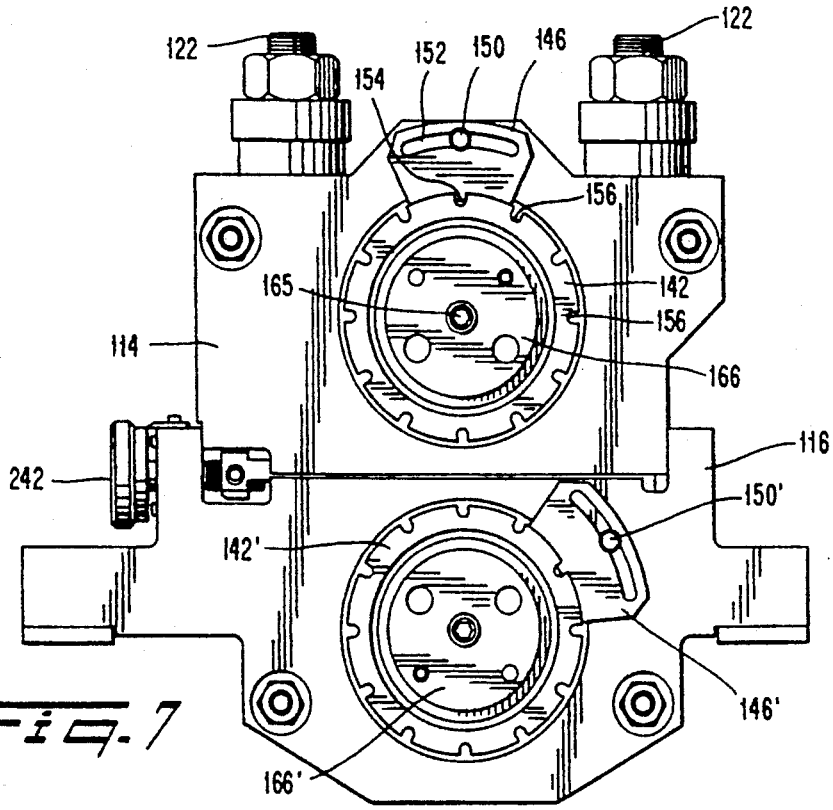
FIG. 7 is a side elevational view of the opposite side of the rollstand.
Figure 8:
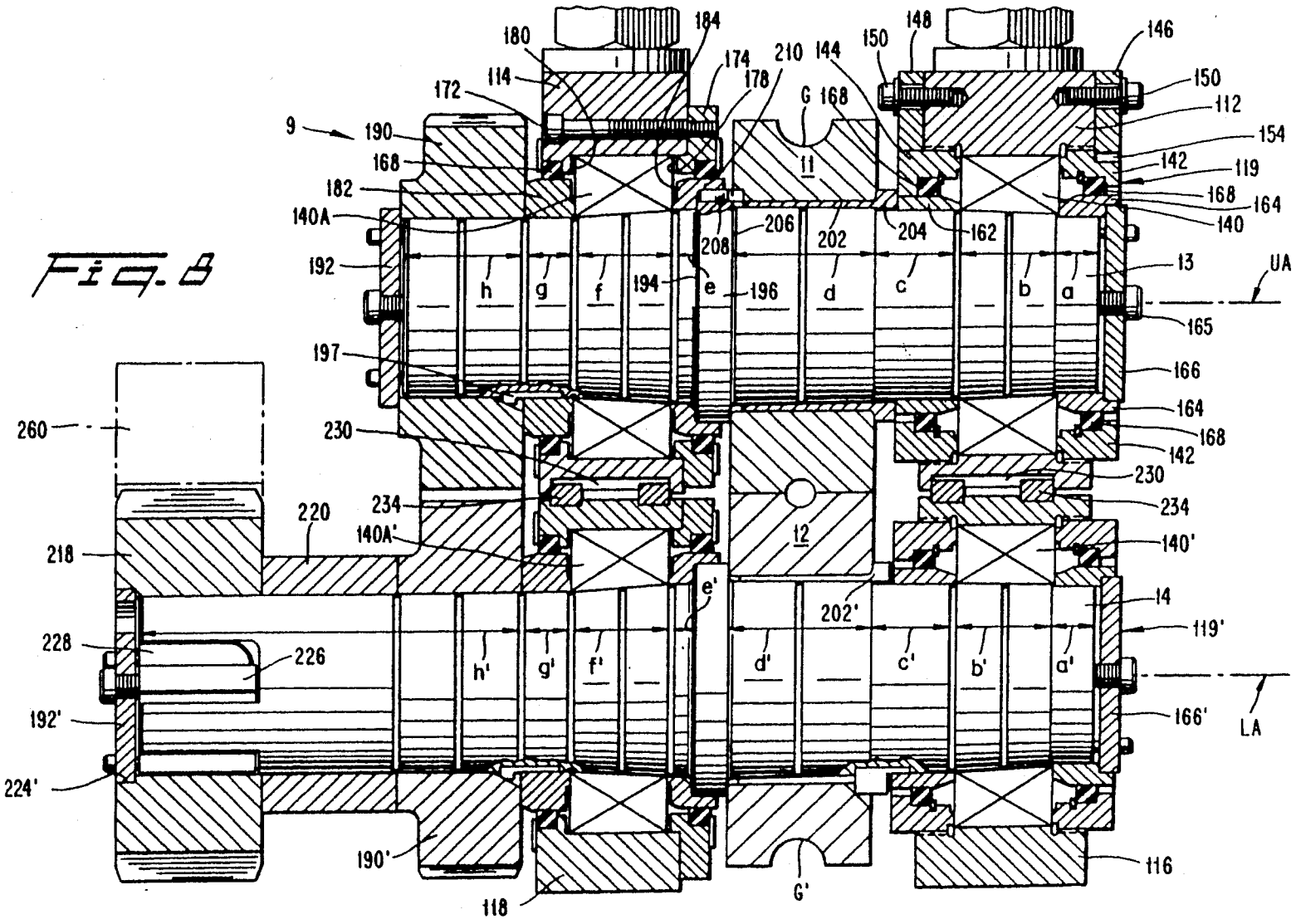
FIG. 8 is a vertical sectional view taken through the rollstand along the line 8—8 in FIG. 6.

Seated within each of the bearing blocks 112, 114, 116, 118 is a conventional roller bearing 140, 140A, 140', 140A' (FIG. 8). Referring to the right upper bearing block 112, for example, the radially outer end of the roller bearing 140 is sandwiched between conventional axially outer and inner adjusting rings 142, 144 which are threadedly secured to the bearing block 112 on opposite sides of the roller bearing 140. A pair of conventional outer and inner locking plates 146, 148 (FIGS. 7, 8) are mounted on the bearing block 112 by means of cap screws 150 which pass through a slot 152 of the respective locking plate. Each locking plate 146, 148 carries a locking lug 154 which is adapted to be received in one of a plurality of recesses 156 in the outer periphery of the adjusting ring. In that conventional fashion, loosening of the adjusting rings 142, 144 is prevented once they have been tightened into contact with the bearing block 112.

Rotatably mounted in the roller bearing 140 is the upper arbor 13 which rotates about an upper longitudinal axis UA. A radially inner end of the bearing 140 is sandwiched between the adjusting rings 142, 144 as well as between a pair of axially inner and outer retaining sleeves 162, 164. Those retaining sleeves are seated on the outer periphery of the upper arbor 13 and abut against axial ends of the bearing 140. The outer retaining sleeve 164 is secured axially by means of an end plate 166 which is bolted by a bolt 165 to an axial end of the arbor and which radially overlaps the outer retaining sleeve.

A pair of axially outer and inner oil seals 168 are radially secured between the adjusting rings and retaining sleeves adjacent opposite axial ends of the roller bearing 140.

The outer retaining ring 164 is mounted on a cylindrical portion a of the outer periphery of the upper arbor 13. The bearing 140 is mounted on a conventional tapered portion b of that outer periphery, the portion b tapering toward the portion a to facilitate a removal of the bearing from the arbor. The inner retaining ring 162 is mounted on a cylindrical portion c of the arbor.

Disposed at an opposite axial end of the upper arbor 13 is the bearing block 114. Secured to an axially inner end of the block 114 by bolts 172 is a retaining ring 174. Disposed coaxially within the block 114 is a roller bearing 140A, the radially outer end of which is sandwiched between a radial shoulder 178 of the retaining ring 174 and a radial shoulder 180 of the block 114 in conventional fashion.

A radially inner end of the roller bearing 140A is axially sandwiched between axially outer and inner retaining sleeves 182, 184 which are seated on the outer periphery of the upper arbor 13. Oil seals 168 are radially sandwiched between the outer retaining sleeve 182 and the block 114 and between the inner retaining sleeve 184 an the retaining ring 174. The oil seals are situated adjacent opposite axial ends of the roller bearing 140A.

Attached to an end of the upper arbor 13 is a spur gear 190. The spur gear is axially retained by an end plate 192 which is bolted to the upper arbor 13 to push the gear 190 against the outer retaining sleeve 182, which in turn, pushes the roller bearing 140A against the inner retaining sleeve 184. The latter is pushed against a radial shoulder 194 of the upper arbor 13. The shoulder 194 is defined by a collar 196 of the upper arbor. A gear key 197 is inserted in a recess of the upper arbor and engages in a recess in the spur gear 190 to effect a positive drive therebetween.

The inner and outer retaining sleeves 184, 182 are mounted on cylindrical portions e, g, respectively, of the upper arbor 13. The bearing 140A is mounted on a tapered portion f of the upper arbor 13, the portion f tapering toward the portion g in order to facilitate removal of the bearing 140A as is conventional. The spur gear 190 is mounted on a tapered portion h of the arbor 13 to facilitate removal of the spur gear.

Mounted on the upper arbor 13 axially intermediate the right and left upper blocks 112, 114 is the upper roll die 11. The upper roll die contains the groove G which defines primary forming, finishing, and dwell portions 30, 31, 32 as described earlier with respect to FIG. 3.

In accordance with the present invention, the upper roll die 11 is disposed on a tapered portion d of the upper arbor 13. That portion d tapers toward the portion c. A tapered wedge sleeve 202 is wedged radially between an inner diameter of the roll die 11 and the tapered portion d. The wedge sleeve possesses a taper corresponding to that of the portion d to eliminate all radial play of the roll die 11. The wedge sleeve 202 includes a head portion 204 which is axially sandwiched between one axial end of the roll die 11 and the inner retaining sleeve 162. The opposite axial end of the roll die 11 abuts a radial shoulder 206 defined by the arbor collar 196.

An upper drive key 208 is disposed in a groove formed in the collar outer periphery. An annular lip 210 of the inner retaining sleeve 184 radially overlies the groove to loosely radially retain the key 208 therein. The key 208 is received in a recess formed in an axial end wall of the roll die 11 to transmit rotary drive forces thereto from the upper arbor 13.

By mounting the roll die 11 on a tapered portion d of the arbor 13 by means of a wedge sleeve, the removal and installation of the roll die 11 is facilitated as compared with the prior art practice of heat-shrinking the roll die onto the arbor.

The upper assembly 119 comprised of the abovedescribed components secured by the upper coupling bolts 120A is mounted on the lower assembly 119' secured by lower coupling bolts 120B. The lower assembly includes components which are similar to those already described in connection with the upper assembly and are designated in the drawing by the same numerals followed by a prime symbol. The roll die 12 of the lower assembly is mounted on a tapered portion d' of the lower arbor 14 by means of a wedge sleeve 202' to facilitate removal of the roll die 12 in the same manner as roll die 11.

The lower assembly 119' further includes a pinion gear 218 affixed coaxially to a cylindrical portion h' of lower arbor 14'. A spacer ring 220 separates the pinion gear 218 from the lower spur gear 190'. An end plate 192' is attached to the lower arbor 14 and is received in an annular groove 224 of the pinion gear 218. A conventional arrangement of two keys 226, 228 is provided to effect a positive drive between the pinion gear 218 an the lower arbor 14. The key 226 effects such a drive connection, while the key 228 acts as a wedge to eliminate play of the key 226.

Figure 9:
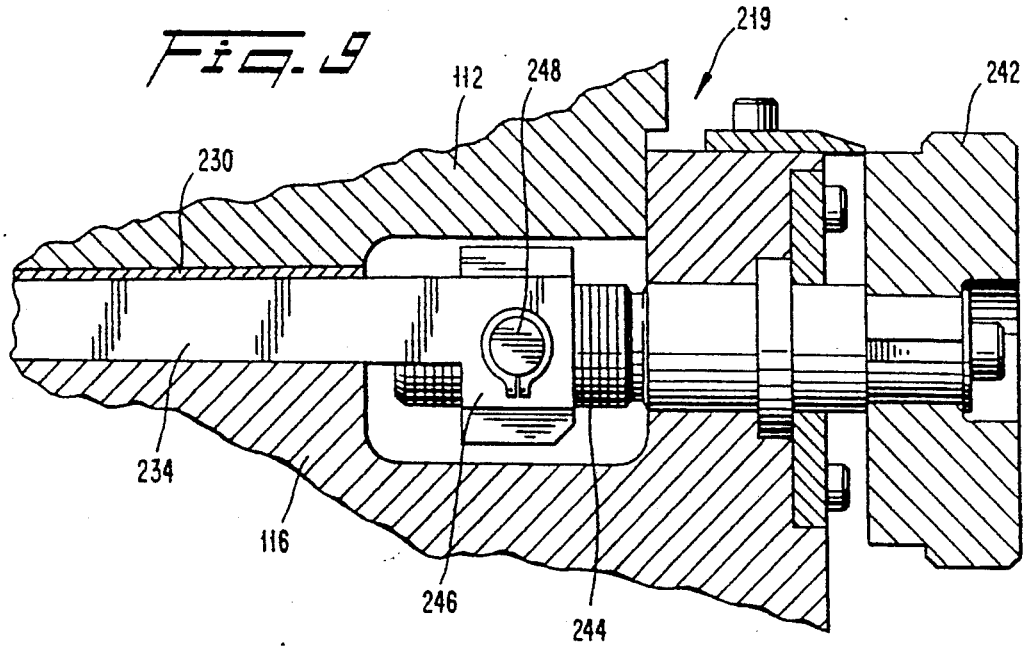
FIG. 9 is an enlarged sectional view of an adjusting mechanism according to the present invention.

Disposed between the upper and lower assemblies 119, 199' are conventional adjusting mechanisms 219 (see FIGS. 8, 9) for adjusting the vertical spacing between the upper blocks 112, 114 and the lower blocks 116, 118. Each adjusting mechanism 219 comprises a slide plate 230 positioned between the respective upper and lower blocks when the upper assembly 119 is placed upon the lower assembly 119'. The slide plate 230 is disposed in an upper groove formed in the underside of the respective block.

Two adjusting wedges 234 associated with each slide plate 230 are disposed partially in the upper groove and partially in a lower groove formed in the top side of the respective lower block. The adjusting wedges 234 are sandwiched radially between the associated slide plate 230 and lower block. An upper portion of each wedge is confined axially between a radial shoulder of the respective upper block and a radial shoulder of the slide plate. A lower portion of each adjusting wedge 234 is confined axially between radial shoulders of the lower groove. It will be understood that each set of components comprised of a sliding plate 230 and associated two adjusting wedges 234 serves to axially locate the upper and lower assemblies 119, 119' relative to one another so that the grooves G, G' of the upper and lower roll dies 11, 12 are properly spaced apart.

Adjustment of each pair of wedges can be effected independently of the other pair by means of manual dials 242. Each dial 242 is affixed to an outer end of an adjusting screw 244, an inner end of which screw is threadedly connected to a wedge clevis 246. The wedge clevis 246 is coupled to the other adjusting wedge 234 by means of a pin 248. Thus, upon rotation of the dial 242, the screw 244 rotates relative to the clevis 246 and causes the two adjusting wedges 234 to be simultaneously linearly displaced.

Figure 6:
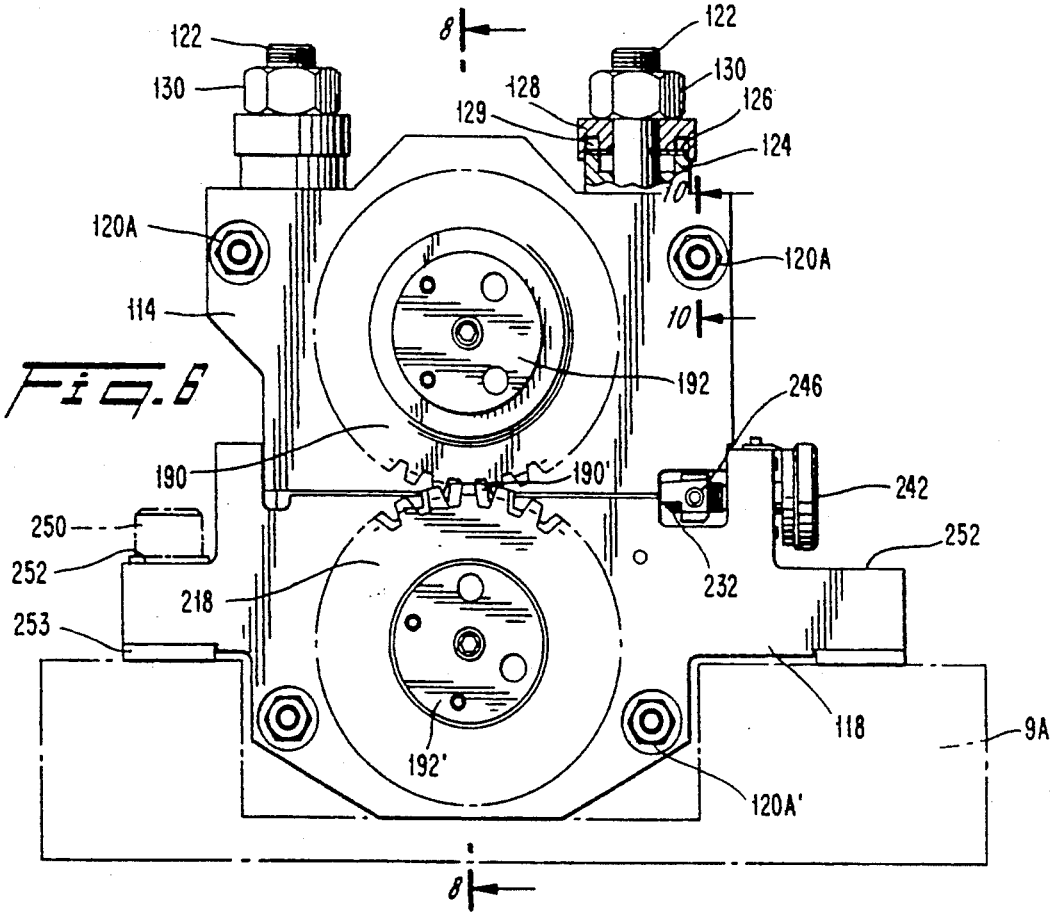
FIG. 6 is a side elevational view of one side of the rollstand, with a portion thereof broken away.

Cap screws 250 are provided at various locations 252 on the lower blocks 116, 118 to connect the rollstand 9 to the sled 9A as can be seen in FIG. 6. Shims 253 can be disposed between the lower blocks and the sled to properly space the rollstand from the sled. The arrangement is such that when the cap screws 250 have been removed, the rollstand 9 can be slid horizontally off the sled in a direction transversely of the direction of sled reciprocation. That is, the rollstand is displaced in a direction perpendicularly of the plane of the paper in FIGS. 6 and 7 (i.e., away from the viewer in FIG. 6 and toward the viewer in FIG. 7). Advantageously, a mobile cart (not shown) can be brought alongside the rollstand 9 and oriented such that a rollstand can be slid onto a surface of the cart for transport. Thus, it is not necessary to completely disassemble the rollstand in the mill. Rather, the rollstand can be easily removed and taken to a separate facility for disassembly. In the meantime, an already-assembled replacement rollstand can be slid onto the sled and attached thereto. Accordingly, the actual downtime of the mill is minimized.

When the crank arm assembly is operated, the sled, saddle and rollstand are linearly reciprocated. Mounted above the pinion gear 218 is a stationary toothed rack 260 (FIGS. 8, 11) which can be fixed to an enclosure (not shown) in which the rollstand reciprocates. The pinion gear 218 meshes with the rack 260 so that reciprocation of the rollstand produces rotation of the pinion gear. The pinion gear thus rotates the lower arbor 14, the lower spur gear 190', and the lower roll die 12. The lower spur gear 190' rotates the upper spur gear 190 which, in turn, rotates the upper arbor 13 and the upper roll die 11.

Since the lower spur gear 190' is located on the same side of the rollstand as the pinion gear 218, the rotary force (torque) from the pinion gear to the lower spur gear is transmitted by a relatively short extent of the lower arbor 14. Accordingly, the lower arbor need not be as strong as arbors which must transmit torque over longer distances (e.g., in cases where the spur gears are located on a side of the rollstand opposite the side where the pinion gear is located). Thus, for example, the lower arbor 14 can be lighter in weight. Consequently, the overall weight of the rollstand is reduced, so that less energy is needed to reciprocate the rollstand. Also, there occurs less wear and tear on the components of the crank arm assembly 7 since less effort is needed to reverse the direction of the reciprocated rollstand.

Figure 11:
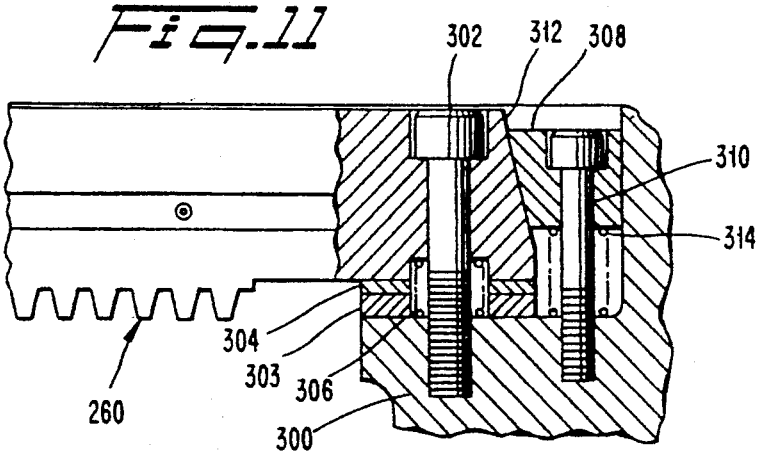
FIG. 11 is a side elevational view of a toothed rack for driving a drive gear of a rollstand.

When the rollstand is removed from the sled, the pinion gear 218 is slid out of engagement with the rack. In order to faciitate such disengagement, there is provided means for raising the rack. As can be seen in FIG. 11, there is provided a housing 300 to which opposite ends of the rack 260 are connected. FIG. 11 depicts the connection at only one end. A bolt 302 extends through the rack and is threadedly received in the housing. A washer 304 and shim 303 are interposed between the rack and the housing. A coil compression spring 306 is arranged between the housing and the rack and is compressed when the bolt 302 is tightened. Thus, when the bolt is released, the spring automatically displaces the rack vertically. A similar spring arrangement can be provided at the opposite end of the rack.

Also provided is a wedge 308 which is attached by a bolt 310 to the housing and is arranged to bear wedgingly against an inclined surface 312 of the rack to insure against accidental loosening of the rack. A coil compression spring 314 is provided for biasing the wedge 308 upwardly.

In order to replace the roll dies 11, 12 it is merely necessary to remove the right upper and lower bearing blocks 112, 116 from the arbors, after removing the end plates 166, 166'. Advantageously, there is no need to remove the spur gears 190, 190' since they are located on the other side of the rollstand along with the pinion gear 218. Removal of the roll dies from the arbors is facilitated since the roll dies are mounted on tapered portions of the arbors 13, 14 by means of the wedge sleeves 202, 202'. Thus, replacement of the roll dies is accomplished relatively quickly and easily since there is no need to disassemble the rollstand and remove the arbors.

Newly installed roll dies which are to operate on differently sized workpieces must be adjusted vertically relative to one another. This is accomplished manually by an operator who must take repeated measurements at the nip zone. This task is made somewhat more convenient by the present invention wherein the spur gears 190, 190' are located on the left side of the rollstand along with the pinion gear 218. Hence, the operator, who makes his measurements from the right side of the rollstand, does not have to reach around the spur gears which would tend to obstruct the operator's motion and present a possible safety risk in the event of accidental premature start-up of the crank arm assembly 7.

It will be appreciated that a rollstand/sled arrangement according to the present invention reduces the downtime of the mill when exchanging roll dies, because the rollstand in the mill can be easily slid from the sled, and substitute rollstand installed in the reverse manner. Accordingly, there is no need to replace the roll dies while the rollstand remains in the mill. The horizontal sliding operation according to the present invention does not require the need for overhead cranes and the like required to lift a rollstand from the sled. Also, the rollstand greatly facilitates replacement of roll dies. Since the drive spur gears are disposed on the same side of the rollstand as the drive pinion gear, the roll dies can be removed from the rollstand without the need to remove the driven spur gears. Furthermore, since the die rolls are mounted on tapered peripheral portions of the arbors by means of tapered sleeves, rather than by a heat shrink connection, the roll dies can be more easily removed. For the above reasons, replacement of the roll dies can be effected rapidly and conveniently, thus reducing the down time of the mill.

Another benefit of locating the pinion and spur gears on the same side of the rollstand, is that the axial distance between the pinion gear and the coaxial spur gear is minimized. Therefore, the axial length of the lower arbor over which torsional force must be transmitted is shorter than in the case where the spur and pinion gears are disposed on opposite sides of the rollstand. This means that a smaller diameter (light-weight) lower arbor can be used. The overall weight of the rollstand is thereby reduced, so as to minimize the amount of energy necessary to reciprocate the rollstand.

Although the present invention has been described in connection with a preferred embodiment thereof, it will be appreciated by those skilled in the art that additions, substitutions, modifications, and deletions not specifically described may be made without departing from the spirit and scope of the invention as defined in the appended claims.

What is claimed is:

1. A rollstand adapted for reciprocation in a front-to-rear direction for reducing the diameter of elongated cylindrical workpieces in a rocker mill, comprising:

upper and lower vertically superimposed bearing block means, adjusting means for adjusting a vertical spacing between said upper and lower bearing block means, first and second bearings mounted in said upper bearing block means, and third and fourth bearings mounted in said lower bearing block means, an upper arbor rotatably mounted in said first and second bearings for rotation about an upper axis extending from a first side of said rollstand to a second side thereof perpendicular to said front-to-rear direction, said upper arbor including first and second outer peripheral portions on which said first and second bearings, respectively, are mounted, said first outer peripheral portion tapering toward said first side of said rollstand, and said second outer peripheral portion tapering toward said second side of said rollstand, a lower arbor rotatably mounted in said third and fourth bearings for rotation about a lower axis extending parallel to said upper axis, said lower arbor including third and fourth outer peripheral portions on which said third and fourth bearings, respectively, are mounted, said third outer peripheral portion tapering toward said first side of said rollstand, and said fourth outer peripheral portion tapering toward said second side thereof, upper and lower roll dies mounted on fifth and sixth outer peripheral portions of said upper and lower arbors, respectively, for rotation therewith, said fourth and fifth peripheral portions tapering toward said first side of said rollstand, each of said roll dies including a groove on its outer periphery, said roll dies being arranged such that said grooves are vertically superimposed to form a nip zone therebetween for compressing a workpiece, an upper tapered sleeve tightly mounted radially between an inner peripheral portion of said upper roll die and said fifth outer peripheral portion, a lower tapered sleeve tightly mounted radially between an inner peripheral portion of said lower roll die and said sixth outer peripheral portion, upper and lower driven gears connected coaxially to said upper and lower arbors, respectively, at said second side of said rollstand and being in meshing engagement, and a drive gear disposed at said second side of said rollstand and connected coaxially with one of said driven gears, said drive gear adapted to meshingly engage a rack whereby reciprocation of said rollstand produces rotation of said drive gear which, in turn, drives the other driven gear for rotating said arbors and said roll dies.

2. A rocker mill according to claim 1, wherein said drive gear is connected coaxially with said lower driven gear.

3. A rocker mill according to claim 1, wherein said upper bearing block means comprises first and second bearing blocks interconnected by upper connecting bolts extending parallel to said axes, said first and second bearings mounted in said first and second bearing blocks, respectively, said lower bearing block means comprising third and fourth bearing blocks interconnected by lower connecting bolts extending parallel to said upper connecting bolts, said third and fourth bearings mounted in said third and fourth bearing blocks, respectively.

4. A rocker mill according to claim 3 including first vertical tension bolts interconnecting said first and third bearing blocks, and second vertical tension bolts interconnecting said second and fourth bearing blocks, respectively.

5. A rocker mill according to claim 3, wherein said adjusting means comprises a first adjusting wedge disposed radially between said first and third bearing blocks, and a second adjusting wedge disposed radially between said second and fourth bearing blocks.

6. A rocker mill for reducing the diameter of elongated cylindrical workpieces, comprising:

a rollstand mounted for reciprocable movement in a front-to-rear direction and including:

upper and lower vertically superimposed bearing block means, adjusting means for adjusting a vertical spacing between said upper and lower bearing block means, first and second bearings mounted in said upper bearing block means, and third and fourth bearings mounted in said lower bearing block means, an upper arbor rotatably mounted in said first and second bearings for rotation about an upper axis extending from a first side of said rollstand to a second side thereof perpendicular to said front-to-rear direction, said upper arbor including first and second outer peripheral portions on which said first and second bearings, respectively, are mounted, said first outer peripheral portion tapering toward said first side of said rollstand, and said second outer peripheral portion tapering toward said second side of said rollstand, a lower arbor rotatably mounted in said third and fourth bearings for rotation about a lower axis extending parallel to said upper axis, said lower arbor including third and fourth outer peripheral portions on which said third and fourth bearings, respectively, are mounted, said third outer peripheral portion tapering toward said first side of said rollstand, and said fourth outer peripheral portion tapering toward said second side thereof, upper and lower roll dies mounted on fifth and sixth outer peripheral portions of said upper and lower arbors, respectively, for rotation therewith, said fifth and sixth peripheral portions tapering toward said first side of said rollstand, each of said roll dies including a groove on its outer periphery, said roll dies being arranged such that said grooves are vertically superimposed to form a nip zone therebetween for compressing a workpiece, an upper tapered sleeve tightly mounted radially between an inner peripheral portion of said upper roll die and said fourth outer peripheral portion, a lower tapered sleeve tightly mounted radially between an inner peripheral portion of said lower roll die and said sixth outer peripheral portion, upper and lower driven gears connected coaxially to said upper and lower arbors, respectively, at said second side of said rollstand and being in meshing engagement, and a drive gear disposed at said second side of said rollstand and connected coaxially with one of said driven gears, a stationary rack extending in a front-to-rear direction and meshingly engaging said drive gear, means for reciprocating said rollstand in a front-to-rear direction relative to said rack whereby said drive gear is rotated to drive said one driven gear which, in turn, drives the other driven gear for rotating said arbors and said roll dies, and means for progressively advancing a workpiece though said nip zone as said rollstand is being reciprocated, whereby the diameter of the workpiece is reduced.

7. A rocker mill according to claim 6, wherein said drive gear is connected coaxially with said lower driven gear and engages a toothed underside of said rack.

8. A rocker mill according to claim 6, wherein said upper bearing block means comprises first and second bearing blocks interconnected by upper connecting bolts extending parallel to said axes, said first and second bearings mounted in said first and second bearing blocks, respectively, said lower bearing block means comprising third and fourth bearing blocks interconnected by lower connecting bolts extending parallel to said upper connecting bolts, said third and fourth bearings mounted in said third and fourth bearing blocks, respectively.

9. A rocker mill according to claim 8 including first vertical tension bolts interconnecting said first and third bearing blocks, and second vertical tension bolts interconnecting said second and fourth bearing blocks, respectively.

10. A rocker mill according to claim 8, wherein said adjusting means comprises a first adjusting wedge disposed radially between said first and third bearing blocks, and a second adjusting wedge disposed radially between said second and fourth bearing blocks.

* * * * *